United States Patent [19]

Herrick

[11] 4,029,260

[45] June 14, 1977

[54] CLEANING AND SANITIZING APPARATUS

[76] Inventor: George A. Herrick, Rte. 1, Box 297, Waskom, Tex. 75692

[22] Filed: Oct. 2, 1975

[21] Appl. No.: 619,040

[52] U.S. Cl. ..... 239/282; 134/100; 239/307; 239/310

[51] Int. Cl.[2] ..... B05B 15/06; B08B 7/30; B05B 3/08

[58] Field of Search ..... 134/100; 239/304, 305, 239/310, 318, 195, 307, 282, 283

[56] References Cited

UNITED STATES PATENTS

| | | | |
|---|---|---|---|
| 1,547,545 | 7/1925 | Wood | 239/305 |
| 2,592,884 | 4/1952 | Fox et al. | 239/318 X |
| 2,943,797 | 7/1960 | Neilson | 239/305 |
| 3,118,610 | 1/1964 | Techler | 239/304 |

*Primary Examiner*—Johnny D. Cherry
*Assistant Examiner*—Andres Kashnikow
*Attorney, Agent, or Firm*—John M. Harrison

[57] ABSTRACT

A cleaning, rinsing and sanitizing apparatus for cleaning and sanitizing food preparation equipment which includes a mounted or portable spray system, including connecting hose, appropriate valving, and a proportionaire or metering valve for selectively mixing incoming streams of water and a selected chemical or chemicals. The system apparatus includes at least two chemical supply tanks with connecting hoses in valved cooperation with the proportionaire valve, such that any one or a combination of chemicals, as desired, can be simultaneously introduced into the proportionaire valve and thence to the spray nozzle in selected concentrations.

5 Claims, 3 Drawing Figures

FIG. 1
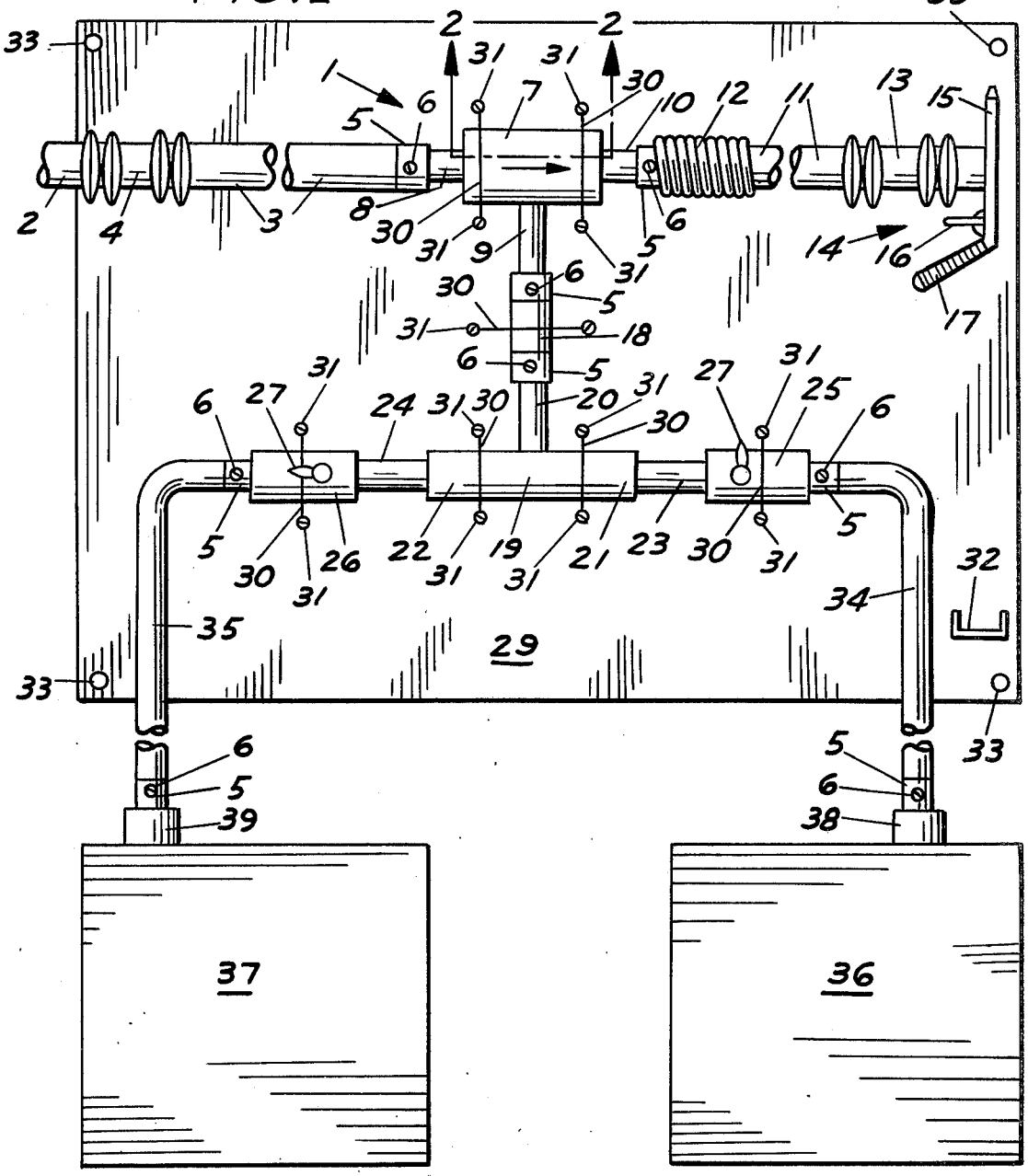
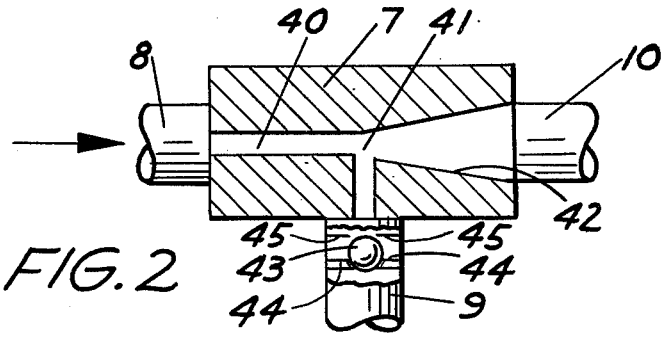
FIG. 2

CLEANING AND SANITIZING APPARATUS

BACKGROUND OF THE INVENTION

1. Field of the Invention

This invention relates to apparatus for cleaning, rinsing and sanitizing food preparation equipment and more particularly, to a spray apparatus which is valved and fitted with at least two chemical supply systems for selectively cleaning, rinsing and sanitizing food preparation equipment. The apparatus of this invention is designed to permit a reliable hot or cold clear water rinse and a spray mixture of one or more selected chemicals in selected proportions to achieve the cleaning, rinsing and sanitizing operations.

2. Description of the Prior Art

It has long been known that food spoilage during the food processing stage of food handling is a difficult problem to solve on a large scale basis. Many micro-orgainisms such as salmonella are pathogenic and are harmful to persons consuming the food. Other organisms operate to cause early food spoilage but are relatively harmless to people ingesting the organisms. Meat spoilage and deterioration begins at the moment of slaughter and continues until arrested by refrigeration or cooking. Accordingly, each stage of the food processing operation is characterized by built-in problems relating to food spoilage and careful steps must be taken to minimize deterioration and contamination during each such processing stage. Personal cleanliness on the part of persons handling the food is essential, as well as the cleanliness of all food preparation and processing equipment such as conveyor packaging systems, meat saws, knives and other cutting implements, and particularly, those which are automated and have crevices and slots where meat particles and juices can lodge to breed micro-organisms.

Food processing and preparation equipment is most generally cleaned by use of a sponge or rag repeatedly dipped in a bucket of soapy water. Continued use of the same soapy water solution can result in a build-up of micro-organisms over a period of time, and the very surfaces which are wiped "clean" may therefore become contaminated. Furthermore, even when a fresh soap solution is used, the rag or sponge may itself be susceptible to accumulation of undesirable organisms, thereby serving to contaminate even a fresh cleaning solution. In addition, the crevices and apertures present on many types of automated apparatus cannot be thoroughly cleaned by this technique since the rag or sponge cannot be forced into these small areas.

Heretofore, a variety of prior art devices typified by U.S. Pat. No. 3,810,787 to Oded Yoeli, et al., have been devised to more thoroughly clean and sanitize food processing equipment. The Yoeli et al. equipment consists of a nozzle gun connected by means of a hose to a "tee" connection, the legs of which are in turn connected to the hot and cold pipes of a water faucet. Separate chemical containers are in turn connected by hoses to the hot and cold water hoses, respectively, and a selected chemical may be made to flow into either the hot or cold water hose by aspiration, with the rate of chemical flow being determined by the rate of hot or cold water flow through the respective hoses.

One problem associated with use of the Yoeli et al. device is apparent due to the undetermined rate of aspiration of the chemicals which can only be controlled at the spray nozzle. If only a hot or cold clear water rinse is desired, merely cutting down on the flow rate of either the hot or cold water or both, will not insure that a small flow of chemical is not aspirated into the flow stream and through the discharge nozzle. Consequently, a clear water rinse, either hot or cold, can only be assured by disconnecting one or both of the chemical hoses, as desired. Furthermore, the system requires a pair of proportionaire or metering devices, one for hot and the other for cold water dispensation. Yet another disadvantage of the apparatus is the requirement for additional plumbing over and above that which is normally an ordinarily supplied in a commercial establishment in order to achieve the desired cleaning, rinsing and sanitizing.

Accordingly, it is an object of the present invention to provide a new and improved cleaning, rinsing and sanitizing spray apparatus for selectively cleaning, rinsing and sanitizing food processing equipment which can be portable or mounted for example and which is valved to assure a selected absolutely non-chemical contaminated fresh hot or cold water rinse and known concentrations of selected chemicals in the wash discharge.

Another object of the invention is to provide a new and improved spray apparatus which can be adjusted to selectively feed one or more chemicals individually or in selected conbination and concentration, into the spray system, as desired.

Yet another object of the invention is to provide a new and improved food processing equipment cleaning, rinsing and sanitizing spray device which can be quickly, easily and selectively connected and disconnected to conventional plumbing fixtures by means of "quick-disconnect" couplings.

A still further object of the invention is to provide a new and improved spray apparatus for cleaning, rinsing and disinfecting food processing and other equipment which is capable of utilizing chemicals at full strength or in diluted solution in the respective chemical storage containers, and is capable of providing a cleaning and sanitizing spray in selected chemical concentration or concentrations.

Another object of the invention is to provide a cleaning, rinsing and sanitizing spray aparatus, the valving and fitting hoses and system of which can be mounted with only the valve handles and spray nozzle exposed or, in the alternative, can be fitted into a compact, portable unit equipped with quick-disconnect fittings adapted to be compatible with substantially any standard hot and/or cold water faucet system.

SUMMARY OF THE INVENTION

These and other objects of the invention are provided in a cleaning, rinsing and sanitizing spray apparatus which includes an inlet and outlet hose, the latter of which is equipped with a cooperating spray nozzle, and a proportionaire or mixing valve disposed therebetween. The apparatus further includes a system of chemical supply hoses with selected valving means to permit inroduction of one or more chemicals into the proportionaire valve and spray nozzle, in controlled, selected concentrations, as desired.

BRIEF DESCRIPTION OF THE DRAWINGS

The invention will be better understood in view of the following description presented with reference to the accompanying drawing.

FIG. 1 of the drawing is a front elevation of the cleaning and sanitizing apparatus of this invention; and FIG. 2 is a side sectional elevation of the proportionaire valve along the lines 2—2 in FIG. 1.

DESCRIPTION OF THE PREFERRED EMBODIMENTS

Figure 3:
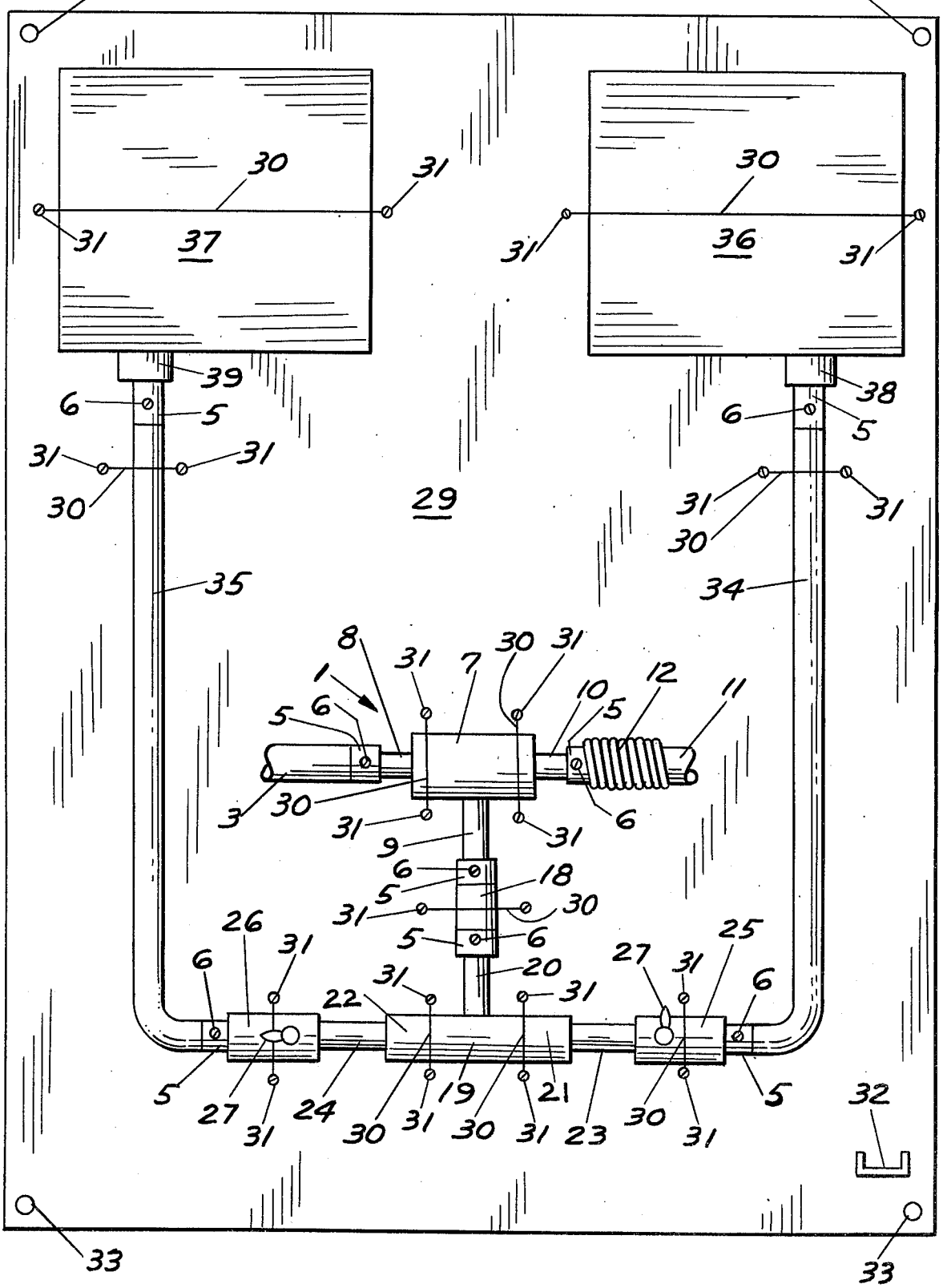
FIG. 3 is a front elevational view of another embodiment of the cleaning and sanitizing apparatus of this invention.

Referring now to FIG. 1 of the drawing, the cleaning and sanitizing apparatus of this invention, generally indicated by reference numeral 1 is disclosed, with water inlet 2, which represents a conventional faucet connection found in substantially all establishments. Water inlet hose 3 is coupled to water inlet 2 by means of inlet quick coupler 4 for instant connection and disconnection of water inlet hose 3 to a source of water. Hose clamp 5 serves to couple water inlet hose 3 to proportionaire valve 7 by means of proportionaire water inlet fitting 8. Hose clamp screw 6 permits ready changing of either proportionaire valve 7 or water inlet hose 3, on a periodic basis as the need arises. Porportionaire valve 7 is also equipped with proportionaire chemical inlet fitting 9 which tees into proportionaire valve 7, illustrated. Proportionaire valve outlet fitting 10 is disposed opposite proportionaire valve water inlet fitting 8, and serves to carry outlet hose 11 by means of hose clamp 5, equipped with hose clamp screw 6. Outlet hose spring 12 is disposed concentrically on outlet hose 11 to minimize fatigue failure of outlet hose 11 at or near its point of juncture with hose clamp 5 and proportionaire valve outlet fitting 10. Outlet quick coupler 13 is carried by the discharge end of outlet hose 11, and serves to permit quick attachment and release of pistol valve 14, fitted with nozzle 15, trigger 16 and handle 17, for convenient, controlled, and direct spraying.

Chemical inlet hose 18 is connected to proportionaire valve chemical inlet fitting 9 by means of hose clamp 5, and to tee fitting 19 by means of tee discharge 20 and another hose clamp 5. To first tee leg 21 is fitted first tee leg nipple 23, and to second tee leg 22 is threaded second tee leg nipple 24, to form two legs of a preferred chemical introduction system. First chemical valve 25 is coupled to first tee leg nipple 23 and second chemical valve 26 is carried by second tee leg nipple 24. In similar manner, first chemical hose 34 spans the distance between and connects first chemical valve 25 and first chemical tank bung 38 of first chemical tank 36. Second chemical hose 35 connects second chemical valve 26 and second chemical tank bung 39 of second chemical tank 37. Hose clamps 5 serve to secure the chemical hoses to the respective valves, and the valves may be internally threaded to receive the tee leg nipples, repectively.

Optional mounting board 29 is designed to carry cleaning and sanitizing apparatus 1 by means of mounting wires 30, secured to mounting board 29 by means of mounting wire screws 31. Mounting bracket 32 is also secured to mounting board 29 to provide a convenient point from which to suspend pistol valve 14. Mounting board apertures 33 are provided to facilitate hanging mounting board 29 on a suitable wall or cabinet near the equipment to be cleaned, rinsed and sanitized.

It will be appreciated that either metal or plastic fittings can be used in the system of this invention, and where metal fittings are selected, either "sweat" fittings or screw fittings can be used to join components. Furthermore, various alternative means such as quick-release clamps, conventional hose clamps, and other devices known to those skilled in the art can be used to join components. When plastic fittings are used, the fittings may be joined to hoses and to each other by means of ferrules or by other techniques known to those skilled in the art. Also, various known techniques other than wire fasteners can be used to hold the apparatus in place on the mounting board.

Referring now to FIG. 2 of the drawing, proportionaire valve 7, more particularly illustrated in section, with connecting proportionaire water inlet fitting 8, proportionaire chemical inlet fitting 9 and proportionaire outlet fitting 10 is illustrated. Throat 40 expands to form cone 42 at chemical inlet 41 to effect a mixing of water entering proportionaire water inlet fitting 8 and a chemical or chemicals entering proportionaire chemical inlet fitting 9 in proper proportions. Proportionaire chemical inlet fitting 9 is equipped with a ball check 43 which seats on check seat 44 to prevent water from entering first and second chemical tanks 36 and 37. Ball retainers 45 are designed to restrain ball check 43 from blocking chemical inlet 41 while at the same time allowing chemical to flow past ball check 43 into cone 42 to mix with incoming water.

It is apparent that various types of proportionaire valves can be utilized in the invention, the function of this component part being used to control the ratio of water to chemical emitted from the spray nozzle, as noted above. For example, a typical and preferred water-to-cleaning agent ratio is 10 to 1, and useful water-to-disinfectant ratio is 256 to 1. Accordingly, a proportionaire or mixing valve which will provide 10 parts water to one part selected chemical may be chosen and used in the system. The cleaning and sanitizing solutions can therefore be added to the storage containers at a chosen strength, with first chemical valve 25 controlling the flow of sanitizing solution selected to produce a flow of sanitizer which will result in a nozzle spray mixture of water and sanitizer of 256 to 1. The selection of first chemical valve 25 and second chemical valve 26 can be made from valves known in the prior art, such as needle valves and simple orifice fittings, as desired. The critical factors to be kept in mind are: first of all, the characteristics of the proportionaire valve chosen to achieve a desired concentration of chemical; and secondly, an auxiliary valving system which will result in a desired nozzle concentration of selected chemical. It will be appreciated that mixing valves of various design can be utilized instead of the proportionaire valve, so long as a check valve is installed in chemical inlet hose 18 to prevent water from backing up into first and second chemical tanks 36 and 37 when pistol valve 14 is not in operation.

It will also be appreciated that a multiple nipple fitting can be inserted in the apparatus illustrated in FIG. 1 in place of tee fitting 19 to permit attachment of multiple chemical hoses to as many cleaning and sanitizing reservoirs as is deemed necessary. Appropriate flow control means such as needle or orifice valves or fittings may also be inserted in the connecting lines as deemed appropriate for cooperation with a selected proportionaire or mixing valve to achieve a desired chemical spray concentration at the nozzle, as heretofore noted.

It is apparent that the flow of selected cleaning and sanitizing agents can be achieved by gravity feed if desired by simply storing the chemicals at a point above the mixing valve system. This feature is shown in FIG. 3. Thus, the position and elevation of the chemical or chemicals can be utilized as yet another parameter in achieving a desired chemical concentration at the spray nozzle during both the cleaning and sanitizing process.

Effecting connection and disconnection of the apparatus is easily achieved by simply mating the quick-disconnect water inlet fitting to a common, single discharge faucet system and initiating the flow of either hot or cold water, as desired. If the system is designed as a portable unit, the valving and fittings may be fitted into a compact unit and, for example, transported in a shopping basket. Furthermore, the hoses may be adapted with quick-disconnect fitings on each end to permit quick coupling and uncoupling and storage whether the unit is portable or mounted.

Those skilled in the art will also recognize that a vacuum breaker system may be easily incorporated into the apparatus of this invention to prevent any chemicals from being pulled into the fresh water system during operation, as desired.

Having described my invention with the particularity set forth above, what is claimed is:

1. A portable, water operated cleaning and sanitizing apparatus removably secured to a mounting board comprising:

a. a mixing valve having an inlet fitting, an outlet fitting and a first tee fitting and including a ball check means;

b. an inlet hose having one end removably fitted to said inlet fitting and the opposite end to the faucet of a conventional water supply system;

c. an outlet hose having one end removably fitted to said outlet fitting;

d. a second tee fitting having a first tee leg nipple, a second tee leg nipple and a tee discharge;

e. a chemical inlet hose connecting said first tee fitting and said tee discharge of said second tee fitting;

f. at least one chemical hose having one end removably fitted to said first tee leg nipple of said second tee fitting, and having the opposite end connected to at least one chemical reservoir;

g. at least one valve in cooperation with said at least one chemical hose between said chemical reservoir and said second tee fitting to control the flow of chemical through said chemical hose and said chemical inlet hose to said mixing valve; and h. a spray nozzle in cooperation with the opposite end of said outlet hose.

2. The cleaning and sanitizing apparatus of claim 1 further comprising quick-disconnect couplings on the end of said inlet hose and said oulet hose not atached to said inlet fitting and said outlet fitting of said mixing valve and an outlet hose spring on said outlet hose where said outlet hose joins said outlet hose fitting.

3. The cleaning and sanitizing apparatus of claim 1 wherein said at least one chemical reservoir is positioned above said mixing valve to assist the flow of chemical from said chemical reservoir into said mixing valve.

4. The cleaning and sanitizing apparatus of claim 1 further comprising quick-disconnect couplings on the ends of said inlet hose and said outlet hose not attached to said inlet fitting and said outlet fitting of said mixing valve, and an outlet hose spring on said outlet hose where said outlet hose joins said outlet hose fitting, and wherein said at least one chemical reservoir is positioned above said mixing valve to assist the flow of said chemical from said chemical reservoir into said mixing valve.

5. The cleaning and sanitizing apparatus of claim 1 wherein said at least one chemical hose is two chemical hoses connected to said first tee leg nipple and said second tee leg nipple of said second tee fitting, said at least one chemical reservoir is two chemical reservoirs, and said at least one valve is two valves in cooperation with said two chemical hoses and located between said chemical reservoirs and said first tee leg nipple and said second tee leg nipple, respectively.

* * * * *